United States Patent [19]

Vackier

[11] Patent Number: 4,480,907

[45] Date of Patent: Nov. 6, 1984

[54] APPARATUS FOR THE LIQUID PROCESSING OF A SURFACE OF A MATERIAL IN THE FORM OF A SHEET, A WEB OR A PLATE

[75] Inventor: Leo N. Vackier, 's-Gravenwezel, Belgium

[73] Assignee: AGFA-GEVAERT N.V., Mortsel, Belgium

[21] Appl. No.: 460,612

[22] Filed: Jan. 24, 1983

[30] Foreign Application Priority Data

Jan. 26, 1982 [GB] United Kingdom ..... 8202099

[51] Int. Cl.[3] ..... G03G 15/10

[52] U.S. Cl. ..... 355/10; 354/317

[58] Field of Search ..... 355/10, 16, 4; 118/662, 118/660; 354/317, 319, 323, 326; 430/117–119

[56] References Cited

U.S. PATENT DOCUMENTS 3,635,144 1/1972 Beck ..... 354/317
3,730,708 5/1973 Jugle ..... 355/4 X
3,929,099 12/1975 Szymber et al. ..... 355/10 X
4,003,651 1/1977 Hashida et al. ..... 355/16
4,013,356 3/1977 Bestenreiner et al. ..... 355/10
4,179,210 12/1979 Bestenreiner et al. ..... 355/10

FOREIGN PATENT DOCUMENTS 796243 10/1968 Canada ..... 355/10

*Primary Examiner*—R. L. Moses
*Attorney, Agent, or Firm*—William J. Daniel

[57] ABSTRACT

An apparatus is described for the liquid processing of a surface of a moving sheet, web or plate. Processing liquid is supplied to the surface via a plurality of elongated discharge orifices extending across the width of said moving sheet or web in an oblique angle with respect to the direction in which said sheet, web or plate is advanced within said apparatus. By the oblique arrangement of the discharge orifices air bubbles entrapped in the processing liquid as a result of pumping can be carried off and processing faults reduced.

12 Claims, 5 Drawing Figures

APPARATUS FOR THE LIQUID PROCESSING OF A SURFACE OF A MATERIAL IN THE FORM OF A SHEET, A WEB OR A PLATE

This invention relates to an apparatus for the liquid processing of a surface of a material in the form of a sheet, a web or a plate during its travel along a predetermined path through said apparatus.

The invention is of particular practical importance for example in the liquid processing of moving plates, webs or sheets carrying latent photographic or electrostatic images.

By liquid processing is meant the uniform application of a liquid to the surface of a material in the form of a sheet, a web or a plate for causing modifications of chemical and/or physical nature on or in the surface layer of the concerned material. In silver halide processing methods, chemical solutions may be fed to the surface in order to render visible a latent photographic image therein, whereas in electrophotographic systems, the electrostatic image carried by the surface is rendered visible by a toner solution fed thereto. Other examples of the utility of such apparatus are e.g. the surface etching of lithographic plates and the modification of the hydrophobic/hydrophilic characteristics of such plates.

Examples of known apparatus, in which the liquid applicator apparatus comprises a liquid-holding chamber, are described in German Patent Application No. 2,942,772 of Ishihara Sangyo Kaisha Ltd. published Apr. 30, 1980 and U.S. Pat. Nos. 3,929,099 of O. Szymber et al. issued Dec. 30, 1975 and 4,148,274 of E. F. Stiévenart et al. issued Apr. 10, 1979.

The uniform distribution of processing liquid to all increments of the surface moving past the discharge orifice of such chamber is not easy to achieve. Under some circumstances disparities occurring in the liquid supply to different surface zones are not readily detectable. This may be so for example when liquid processing light-sensitive materials in continuous tone photocopying. But when endeavouring to develop electrostatic latent halftone images in the form of a pattern of small dots with a prior art apparatus, the defects in the processing liquid supply have become evident. in such applications the degree of uniformity of the liquid supply is more critical for the processing quality. The defects referred to are manifest as small areas where the developed image density is relatively low. This points to local deficiencies in the availability of processing liquid.

The present invention enables more uniform processing to be achieved by providing an apparatus for the liquid processing of the bottom surface of a material in the form of a sheet, a web or a plate, comprising means for supporting such material and for advancing and guiding the same through the apparatus in a given direction along a predetermined path inclined to the horizontal, a plurality of successive supply chambers which are disposed underneath this path and sequentially deliver processing liquid to the surface via discharge orifices, the discharge orifices being disposed in a common plane which is parallel to the plane of material when the latter is advancing along path passing above such discharge orifices, characterized in that each of the discharge orifices is an elongated orifice running with its lengthwise dimension in a direction across the path of travel, the latter direction being non-perpendicular to the direction of travel of the material along this path.

In the course of investigations into the cause of the defects hereinbefore referred to, it was found that small air bubbles may be present in the flow of processing liquid, e.g. as a consequence of intensive pumping. Especially when developing fine screen-images such bubbles are likely to cause processing faults manifest as areas of lower image density as above referred to. When carrying out the development with an apparatus according to the present invention, this undesirable effect is less liable to occur. Indeed, due to the particular orientation of the elongated discharge orifices, a material to be treated advancing over the liquid supply chambers is thus moving progressively past the length of each of the orifices and if any small air bubbles are present in the liquid at one or more of said orifices they tend to be progressively shifted to the furthermost downstream extremity of these orifices.

Another favourable effect produced by the oblique orientation of said discharge orifices resides in the fact that the impact of the leading edge of a material to be treated upon the flow of processing liquid delivered at the discharge orifices occurs gradually so that a possible disturbance of the regular flow of processing liquid out of the discharge orifices is largely avoided.

While an apparatus according to the present invention is particularly suitable for the development by a liquid developer of electrostatic half-tone images comprising a distribution of fine dots, carried for example by an electrographic sheet, web or plate, such apparatus is equally applicable for other liquid processing purposes. It can for example be employed for overall or selectively wetting a sheet or web surface as a step in preparing such sheet or web as an offset printing plate.

The words "processing liquid" as used herein include not only a true liquid, but also a solids/liquid dispersion. The phrase therefore include for example a toner solution for developing electrostatic images or a dispersion of solid toner particles dispersed in a liquid carrier, as used in electrophoretic development. Further examples of processing liquids are chemical solutions useful in the processing of silver halide photographic materials, and preparations useful for etching the surfaces of lithographic plates or for modifying the hydrophobic/hydrophilic characteristics thereof.

In preferred embodiments of the invention, the processing liquid flows upwardly from the supply chambers to the elongated discharge orifices and the path of the material through the apparatus is spaced above the level of the orifices by a distance such that the processing liquid delivered at the orifices is capable of entering into contact with the material when the latter is moving past the orifices.

Preferably, each supply chamber is an elongated supply chamber which has an elongated discharge orifice and which can hold a quantity of processing liquid.

A preferred embodiment of an apparatus according to the invention includes a plurality of successive elongate supply chambers wherein the discharge orifices run parallel to each other, so that they all extend at the same non-perpendicular angle with respect to the direction of advance of the material through the apparatus.

The discharge orifices are arranged in a common plane parallel with the plane occupied by the material, i.e. the plane of the path along which the material is advancing within the apparatus when it is passing over the discharge orifices. The latter parallel planes are inclined downwardly from the horizontal.

It is evident that when throughout the present specification reference is made to "acute" angles between the elongated orifices of the supply chambers and the direction of travel of the material the apparatus of the invention or the leading edge of the material respectively, the supplementary obtuse angles are automatically included as well. For the sake of clarity of the specification, however, reference is only made to the acute angles.

Preferably, each supply chamber of an apparatus according to the invention has a top wall with an elongate discharge orifice located at the upstream edge thereof with respect to the sense in which the material is progressing within said apparatus and the top wall is formed as a plate, e.g. made of metal, which, in the case of an apparatus for electrophoretic development, may serve as a development electrode. Each such development electrode, i.e. the top wall of each such supply chamber, assumes an inclined position relative to the horizontal and preferably is disposed in a common plane with the other similar electrodes which plane runs parallel with the plane taken by the material within said apparatus, so that an almost laminar downstream flow of liquid in the sense of travel of the material within the apparatus can be obtained.

Each supply chamber may take the form of as a hollow container, to which processing liquid is fed through an inlet conduit passing through the bottom or near the bottom part of the container. As a consequence, an air cushion is created in the chamber above the liquid level when the apparatus is in operation so that turbulences in the flow of liquid supplied by pump means can be greatly reduced.

In order to further increase the uniformity of flow of the processing liquid passing through the discharge orifices, the supply chambers may have their inlet conduits connected to a common distributing element, e.g. a manifold, via which the main supply of processing liquid is distributed to the different supply chambers. The common distributing element is preferably constructed in such a way that when it is in operation, an air cushion is formed above the liquid level therein. A supplementary advantage of the latter embodiment resides in the fact that only one pump means for supplying the processing liquid is required.

In order to maintain the air cushions referred to above in a steady state whereby air carry-over to the discharge orifices is avoided, the interior of each supply chamber may be provided with a "brake" plate consisting of a plate provided with a plurality of holes and which is located at or near the plane of the liquid level in the interior of the supply chamber and surrounds the inlet conduit of the supply chamber.

In a preferred embodiment, the liquid which is not consumed during the processing of the surface of the material overflows the downstream edges of the supply chambers and can be collected in a tray arranged under the supply chambers.

The invention will hereinafter be described more in detail with reference to the annexed drawings, in which.

Figure 1:
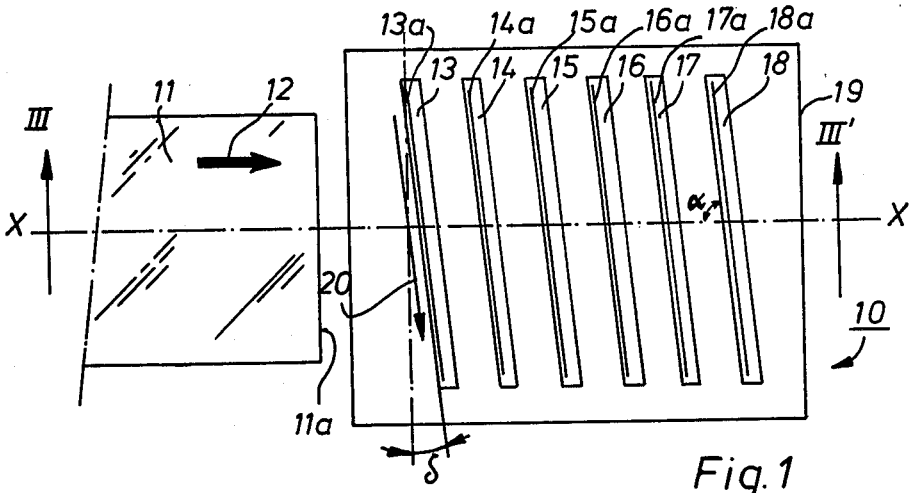
FIG. 1 is a top view of an apparatus according to the invention.

In FIG. 1 an apparatus 10 according to the invention is represented which is intended for the liquid processing of a material in the form of a sheet 11 whose bottom surface (not shown) bears an electrostatic latent image to be developed.

Sheet 11 is advanced, guided and supported by means (not shown) within apparatus 10 along a path X—X and in a direction indicated by arrow 12.

Apparatus 10 comprises a plurality of supply chambers 13–18, each of these chambers being provided with an elongated discharge orifice **13*a*–18*a* respectively, via which a flow of toner liquid is supplied by means of pump means (not shown) to the bottom surface of sheet 11** and over substantially the entire width thereof, thereby rendering visible the electrostatic latent image.

The surplus of toner liquid, delivered by discharge orifices **13*a*–18*a* for processing sheet 11, which is not consumed during this processing cycle, in other words, the excess of delivered processing liquid, is collected in a tray 19 and is supplied to a container (not shown) for processing liquid and to the said pump means so that a continuous flow of liquid is obtained in the unit defined by supply chambers 13–18, collecting tray 19**, the pump means and the container.

According to the present invention and in order to avoid possible processing faults due to the presence of air bubbles in the flow of processing liquid through discharge orifices **13*a*–18*a*, supply chambers 13–18 and their associated discharge orifices 13*a*–18*a* are disposed at an oblique angle $\alpha$ with respect to the path X—X along which sheet 11 travels within apparatus 10. Angle $\alpha$ is chosen so that air bubbles, which might occasionally be present in the flow of processing liquid delivered by discharge orifices 13*a*–18*a*, are gradually and laterally displaced as is indicated by arrow 20, for instance, when the leading edge 11*a* of sheet 11 is passing over discharge orifices 13*a*–18*a***.

This advantageous effect wherein air bubbles are carried away is obtained when angle $\alpha$ is not equal to 90°. Any value for angle $\alpha$ other than 90° is suitable for obtaining the advantageous effect with the apparatus of the present invention, but preferably angle $\alpha$ is chosen between 80°–87° depending e.g. on the speed at which sheet 11 is progressing within apparatus 10. As a consequence of this particular orientation of the discharge orifices **13*a*–18*a* with respect to the path X—X, the unwanted processing faults caused by the presence of the air bubbles referred to is largely avoided and at the same time the entering into contact of the leading edge 11*a* of sheet 11 with the layer of processing liquid delivered at discharge orifices 13*a*–18*a* can occur less abruptly since leading edge 11*a* of sheet 11 is passing over discharge orifices 13*a*–18*a* at an acute angle $\delta$, which is preferably chosen between 3° and 10°. As represented in FIG. 1**, angle $\delta$ is the complement of angle $\alpha$.

Figure 2:
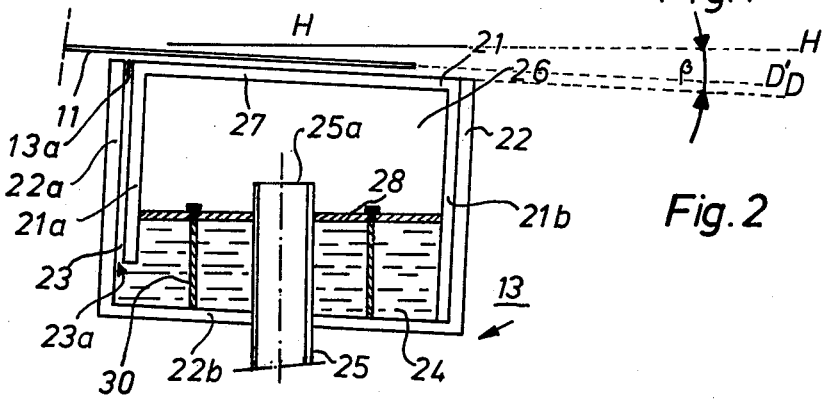
FIG. 2 is an enlarged sectional view of an individual supply chamber.

FIG. 2 is an enlarged sectional view of a supply chamber 13 with its discharge orifice **13*a***.

A supply chamber 13 is generally formed as an assembly of two mutually inverted U-shaped elongate members 21 and 22, e.g. made of metal, which defines a longitudinal space that is closed at both its ends by transverse side walls (not shown) and thus forms an elongated container.

The width of U-shaped member 21 is slightly smaller than the width of member 22, so that an elongated channel 23 is formed between two vertical neighbouring legs, e.g. legs 21*a* and 22*a* respectively, of the inverted U-shaped members 21 and 22 respectively in the assembly.

In the present embodiment, leg 21*a* of member 21 is shorter than its other leg 21*b*, so that a passage 23*a* is provided between the interior bottom part of supply chamber 13 and channel 23.

The opening at the top end of channel 23 is lying in substantially the same plane as the top wall 27 of supply chamber 13 and constitutes the discharge orifice 13*a* of chamber 13. Preferably discharge orifice 13*a* is disposed at the upstream edge of top wall 27 with respect to the direction of travel of the material within apparatus 10.

Processing liquid 24 is fed to the interior of chamber 13 by pump means (not shown) via an inlet conduit 25 penetrating into said chamber 13 through bottom 22*b* of the latter.

Since the opening 25*a* of conduit 25 within chamber 13 is situated above the lower edge of the short leg 21*a* of inverted U-shaped member 21, an air cushion 26 is created above the level of processing liquid 24 in supply chamber 13.

Preferably, a brake plate 28 for the processing liquid 24 may be provided in supply chamber 13 for reasons set forth hereinafter.

Pressure variations, which may occur during the supply of processing liquid can be greatly compensated for not only by the air cushion 26 but also by the brake plate 28 which can absorb them to a large extent.

Leg 27 of inverted U-shaped member 21 constitutes the top wall of supply chamber 13 and acts in the present embodiment as a development electrode for processing sheet 11.

A development electrode, as known by those skilled in the art, serves the purpose of orienting the electric field lines created by the electrostatic latent image, so that solid areas may be uniformly developed.

The particular construction of supply chamber 13, wherein electrode 27 is inclined in a slightly downward direction with respect to the horizontal H, allows the processing liquid to be delivered through discharge orifice 13*a* as a laminar flow which runs over top wall 27 of U-shaped member 21, i.e. over the development electrode 27, so that no preferential fluid pattern is built up between electrode 27 and sheet 11 when the latter is passing over the former.

The plane D of electrode 27 forms an angle with the horizontal plane H. This angle of inclination $\beta$ of electrode 27 with respect to the horizontal H is so chosen that the relative difference in speed between the layer of processing liquid overflowing it and the bottom surface of advancing sheet 11 is at a minimum and is preferably zero.

Supply chambers 14–18 and discharge orifices 14*a*–18*a* are advantageously constructed the same way as supply chamber 13 and discharge orifice 13*a* respectively, described hereabove.

Figure 3:
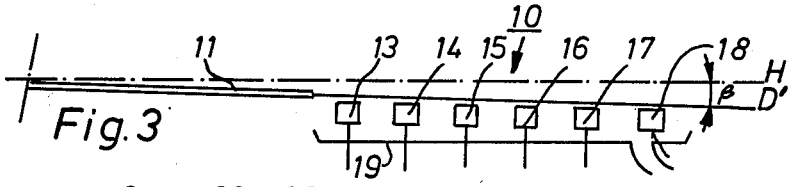
FIG. 3 is a sectional view according to line III—III' in FIG. 1.

FIG. 3 shows sheet 11 being fed to the processing area in apparatus 10 essentially constituted of a plurality of successive supply chambers 13–18 whose top planes are all lying in a common plane D which is inclined over an angle $\beta$ with respect to the horizontal H.

Preferably, each supply chamber is positioned somewhat lower than the one immediately upstream thereof, but the corresponding discharge orifices 13*a* to 18*a* are all located in the same common inclined plane D, so that a uniform distance is always guaranteed between that plane D and the parallel plane D′ in which sheet 11 is moving. For the sake of clarity, the planes D and D′ are not shown separately in FIG. 3 as it is in FIG. 2 in which it can be seen that plane D′ is parallel to plane D and that it consequently forms the same angle $\beta$ with the horizontal H.

Figure 4:
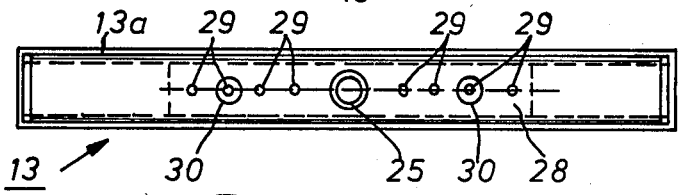
FIG. 4 is a top view of the supply chamber of FIG. 2.

FIG. 4 is a top view of the single supply chamber 13 of FIG. 2 in which a brake plate 28 is provided.

In the present embodiment, brake plate 28 is formed as a plate, e.g. made of metal, with a width substantially corresponding to the inner width of supply chamber 13. The length of brake plate 28 may also be substantially equal to the inner length of supply chamber 13 but a smaller length, as is represented in the example of FIG. 4, may also be advantageous. Brake plate 28 extends lengthwise at both sides of inlet conduit 25 and it is provided with a plurality of threaded holes 29 which can engage threaded spindles 30, e.g. provided in the bottom 22*b* (FIG. 2) of chamber 13, so that the distance between the bottom 22*b* of supply chamber 13 and the brake plate 28 can be adjusted.

Normally brake plate 28 is lying flush with the level of toner liquid 24 present in supply chamber 13. This brake plate 28 is intended as a device for damping possible excessive turbulence in the processing liquid during pumping, so avoiding air to be taken away from the air cushion 26 present in supply chamber 13 and to be delivered together with the processing liquid at discharge orifice 13*a*.

Figure 5:
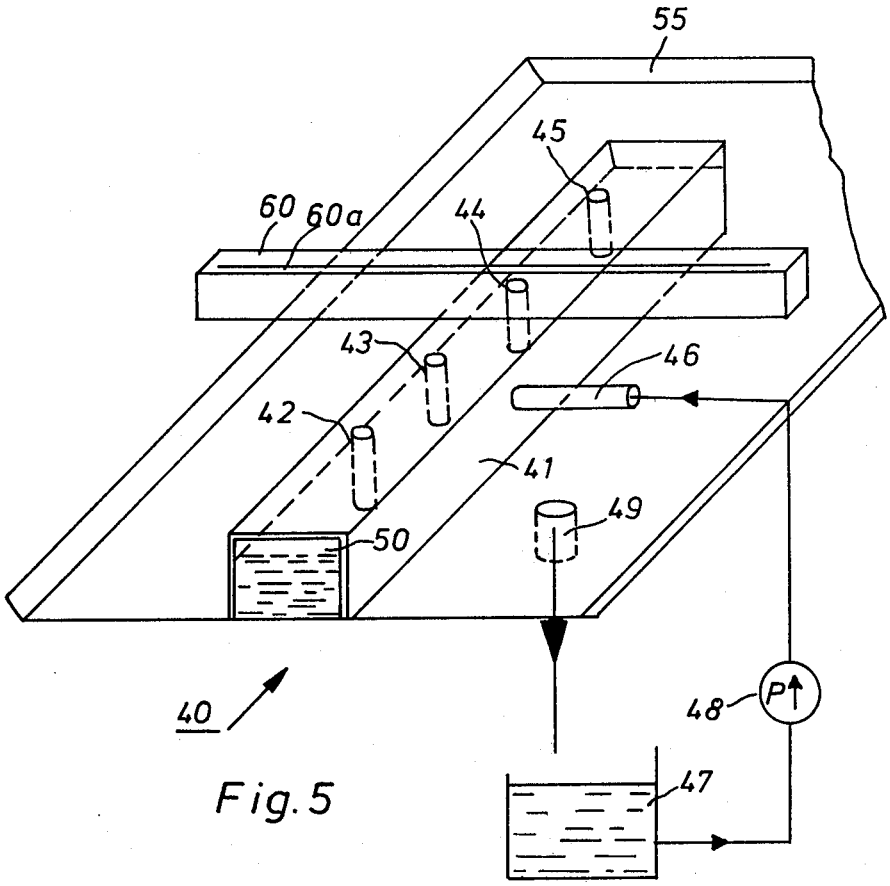
FIG. 5 is a perspective view of a section of another embodiment of an apparatus according to the invention.

In FIG. 5 another embodiment 40 of an apparatus according to the present invention is illustrated, which differs from the one represented in FIG. 1 in that a manifold 41 is provided which has four outlet openings 42, 43, 44 and 45, each communicating with an associated inlet conduit in a corresponding supply chamber of the type described hereinbefore. For the sake of clarity only one such supply chamber 60 with a discharge orifice 60*a* is shown in FIG. 5.

Manifold 41 has an entrance nozzle 46 via which processing liquid is supplied from a storage tank 47 via a pump 48.

Excess processing liquid can be collected in a tray 55 and can be fed again to storage tank 47 via an outlet opening 49 in tray 55.

As the outlet openings 42–45 extend above the bottom of manifold 41, an air cushion 50 is created above the liquid level in manifold 41.

Each of the corresponding supply chambers of the type generally represented by numeral 60 in FIG. 5 can also have an air cushion above its individual liquid level and can be provided with a brake plate as is explained hereinbefore.

The provision of a series of successive air cushions in the combination of manifold 41 and supply chambers 60 results in a flow of processing liquid that is very regular and hence, by keeping the pressure in the whole circuit rigorously constant, flow fluctuations through the discharge orifices can be largely avoided. This favourable effect can even be noticed at relatively high flows of processing liquid (e.g. 35 liters/minute).

The provision of a manifold 41 involves the additional advantage that only one pump 48 is needed for circulating the processing liquid.

We claim:

1. An apparatus for the liquid processing of the bottom surface of a plane material in the form of a sheet, a web or a plate, comprising means for supporting said material for advancement through said apparatus in a given direction along a predetermined generally straight path inclined to the horizontal, a plurality of supply chambers arranged in succession along the underside of said path for sequentially delivering processing liquid to said surface via discharge orifices in the upper ends of said chambers, said discharge orifices being disposed in a common plane which is parallel to the plane of said material traveling along said path, each of said discharge orifices being elongated with its lengthwise dimension intersecting said path of travel at an oblique angle.

2. Apparatus according to claim 1, wherein said discharge orifices extend parallel to each other and all intersect said path of travel at the same oblique angle.

3. Apparatus according to claim 1, wherein each of said supply chambers has a top wall with an elongated discharge orifice located at the upstream edge thereof with respect to the direction of travel of said material within said apparatus.

4. Apparatus according to claim 1, wherein the clearance between each of said discharge orifices and said path of travel is such that processing liquid, flowing upwardly from said supply chambers to and out of said elongated discharge orifices, is capable of entering into contact with the bottom surface of said material when the latter is moving over said orifices.

5. Apparatus according to claim 3, wherein the top wall of each of said supply chambers is electrically connected to form an electrode for the development of latent electrostatic images.

6. Apparatus according to claim 1, wherein said elongated discharge orifices extend at an angle between 80 and 87 degrees with respect to the direction of travel of said material within said apparatus.

7. Apparatus according to claim 1, wherein each of said supply chambers is an assembly of two mutually inverted telescoping elongated U-shaped channels which together define an elongated space therewithin that is closed at both its ends by transverse side walls, and wherein the thickness of the inner one of said U-shaped channels is smaller than that of the other U-shaped member so that an elongated orifice is formed by the clearance between two neighbouring vertical leg walls of said inverted elongated U-shaped channels when assembled.

8. Apparatus according to claim 7, wherein one vertical leg wall of the inner one of said U-shaped channels is shorter than the other vertical leg wall thereof so that an inlet opening is formed at the bottom of said orifice formed by the clearance between said leg walls.

9. Apparatus according to claim 8, wherein a liquid brake plate is provided around an inlet conduit penetrating the bottom of said supply chamber for feeding the latter with processing liquid, said brake plate being located substantially in the plane of the level of the processing liquid in said chamber.

10. Apparatus according to claim 9, wherein the distance between said brake plate and the bottom of said chamber is adjustable.

11. Apparatus according to claim 1, wherein said plurality of supply chambers are supplied by a common distributing manifold with processing liquid.

12. Apparatus according to claim 11, wherein each of said chambers has an inlet conduit connecting the same to said manifold and extending in the manifold below the level of the processing liquid present therein so that an air cushion is formed above said level of processing liquid in said manifold.

* * * * *